United States Patent [19]

Reddoch

[11] Patent Number: 4,625,755

[45] Date of Patent: Dec. 2, 1986

[54] KELLY MUD SAVER VALVE SUB

[76] Inventor: Jeffery A. Reddoch, 106 Weeks Dr., Youngsville, La. 70505

[21] Appl. No.: 638,371

[22] Filed: Aug. 7, 1984

Related U.S. Application Data

[63] Continuation-in-part of Ser. No. 386,711, Jun. 9, 1982, abandoned.

[51] Int. Cl.[4] ..... E21B 21/40

[52] U.S. Cl. ..... 137/327; 137/493.2; 137/493.9; 137/533.31; 166/325

[58] Field of Search ..... 137/493.2, 493.9, 327, 137/508, 515.5, 533.17, 543.21, 496, 515, 533.31; 175/218; 166/324, 325

[56] References Cited

U.S. PATENT DOCUMENTS

| | | | |
|---|---|---|---|
| 548,834 | 10/1895 | Lafferty | 137/326 |
| 2,855,952 | 10/1958 | Tausch et al. | 137/508 |
| 2,994,280 | 8/1961 | Daffin | 166/324 X |
| 3,965,980 | 6/1976 | Williamson | 175/218 X |
| 3,967,679 | 7/1976 | Liljestrand | 175/218 X |
| 4,128,108 | 12/1978 | Parker et al. | 137/327 |
| 4,185,655 | 1/1980 | Wilkes et al. | 137/533.17 X |
| 4,364,407 | 12/1982 | Hilliard | 166/325 X |

*Primary Examiner*—Martin P. Schwadron
*Assistant Examiner*—Stephen M. Hepperle
*Attorney, Agent, or Firm*—Klarquist, Sparkman, Campbell, Leigh & Whinston

[57] ABSTRACT

A Kelly Mud Saver Valve Sub is provided having a tubular valve body with an annular seat fixed in the interior of the valve body. A tubular closure member is reciprocally mounted within the valve body, and is biased with a helical spring into a closing relationship with the annular seat. Unidirectional seals are provided around the closure member to form a chamber in which the spring is retained, the unidirectional seals permitting fluid only to leave the chamber but not enter it. Spacer rings are provided at the downhole end of the chamber to prevent downhole pressure from being communicated past the spacer rings. The closure member in the valve accordingly opens solidly under the force of hydraulic pressure since the pressure acts against a larger area of the uphole end of the closure member than of the downhole end. In especially preferred embodiments, the unidirectional seal around the uphole end of the closure member is carried by the walls of the valve body so that the body of the closure member is protected from the turbulent flow of drilling mud when the closure member is in an open position. The end of the closure member which seats against the annular seat can also be provided with a removable plate that selectively seals the end of the closure member which seats against the annular ring when the valve is in an open position. This plate can be selectively removed from the end of the closure member by exerting upward pressure against a spear on the plate to inwardly deform four depending legs which hold the plate within the closure member. The plate can easily be reinserted into the closure member by inwardly deforming the depending legs and pushing the plate downwardly into the closure member.

2 Claims, 8 Drawing Figures

KELLY MUD SAVER VALVE SUB

CROSS-REFERENCE TO RELATED APPLICATION

This is a continuation-in-part of U.S. patent application Ser. No. 386,711 filed June 9, 1982, now abandoned. The disclosure of that application is incorporated by reference as fully as if it appeared herein.

BACKGROUND OF THE INVENTION

1. Field of the Invention

This invention concerns a Kelly Mud Saver Valve Sub for preventing loss of drilling mud from above the valve when the drill string is broken below the valve.

2. Discussion of the Prior Art

In the drilling of oil and gas wells, a drill string is lengthened by disconnecting the kelly from the drill string and inserting an additional segment of drill string between the kelly and the existing string. When the connection between the kelly and the drill string is broken, drilling mud contained within the kelly spills out onto the job site. Spillage of the drilling mud presents hazards to the safety of drilling personnel, increased expense as a result of the wasted mud, environmental pollution, and time delays occasioned by the necessity of removing workmen from the site to avoid mud spray.

To prevent spillage of the mud when the connection with the drill string is broken, mud saver valves have been developed for placement between the drill string and the kelly. These valves are designed to open when drilling mud is introduced into the drill string, but to close when the introduction of drilling mud stops. Closure of the valve retains mud in the kelly when the connection with the drill string is broken.

An example of an unsuccessful attempt to design such a valve is shown in U.S. Pat. No. 4,364,407 issued to Hilliard, which shows a mud saver valve having a tubular body with an annular seat ring mounted within the body. A closure member is axially movably mounted within the body for engagement with the seat ring. The closure member includes a bore substantially coaxially aligned with the central opening of the annular seat ring, and a flange extends radially outwardly from the closure member to slidingly engage the interior of the cylindrical body. A plug is removably mounted in the closure member with a shear ring, and the plug is movable between a first position in which the plug sealingly engages the shear ring and a second position that allows fluid to flow upwardly between the plug and the shear ring. The Hilliard device has, however, only a single seal around the flange that extends radially outwardly from the piston. Accordingly, the piston opens and closes in response to the flow of mud from the kelly into the drill string. Since most drilling operations use duplex or triplex pumps, there is a variation in the flow of drilling mud, and as the flow varies the entire valve oscillates up and down thereby causing wear on the flange, annular seat ring, and adjacent parts thereto. Hilliard also suffers from the drawback that the bore of the sub and the flange are exposed to the turbulent flow of abrasive drilling mud, and is accordingly worn down quickly in use.

U.S. Pat. No. 4,128,108 issued to Parker, et al has the same problem as Hilliard, i.e, there is only one seal at the top of the closure member so that the force of the velocity of the drilling mud holds the tool in its open position. Another problem with Parker is that the seating faces of the closure member and annular seat are flat, which provides a leak path for mud under high pressure because flat faces do not self center.

U.S. Pat. No. 3,965,980 issued to Williamson came closer to solving the problem of oscillation in the valve due to variation in flow of the mud. Williamson provided a piston body having unidirectional seals at its top and bottom, thereby forming an annular chamber around the piston body. The one way seals permit fluid to leave the annular chamber, but not enter it; the piston body then theoretically opens and closes in response to differential hydraulic force above and below the piston, thereby avoiding oscillation of the piston in response to variations of flow from duplex or triplex pumps. Williamson, however, did not provide any means for reducing the surface area of the piston against which the downhole pressure works. The Williamson valve accordingly should require higher pressures to open, is subject to closing if these higher pressures are not maintained, and still oscillates.

Accordingly, it is an object of the present invention to provide a kelly mud saver having a reciprocating closure member provided with first and second unidirectional seals which define the ends of an annular chamber around a closure member. The unidirectional seals permit fluid to leave the annular chamber but not enter it, thereby permitting the closure member to open and close in response to hydraulic force in the system instead of in response to the force of the velocity of mud flow.

It is also an object of the invention to provide such a valve with a stationary snap ring carried by the tubular valve body which surrounds the closure member. This snap ring prevents downhole pressure from being communicated to the reciprocal closure member, thereby reducing the surface area against which the downhole pressure is exerted. As a result, lower uphole pressure is required to open the closure member, and once open the closure member stays more firmly in the open position.

It is also an object of the present invention, in certain embodiments, to provide a spear assembly axially movably mounted within the closure member for venting excessive downhole pressure past the valve. In especially preferred embodiments, the spear assembly is held within the closure member by a plurality of deformable legs which permit the spear to be selectively inserted or removed from the closure member without the necessity for repairing the spear assembly in a shop.

It is also an object of the invention to provide preferred embodiments in which the body of the closure member is protected from turbulent flow of abrasive drilling mud when the valve is in an open position.

SUMMARY OF THE INVENTION

The foregoing objects are achieved by providing a mud saver valve comprising a tubular valve body with a first end adapted for attachment in fluid communicating relationship with a kelly, and a second end adapted for attachment to a drill string. An annular seat is fixed in the interior of the valve body adjacent its first end. A tubular closure member is reciprocally disposed within the valve body, and the closure member is provided with a selectively closed seating end for seating in valve closing engagement with the annular seat. The other end of the closure member is open, and the closure member is provided with an annular expansion adjacent the seating end. A pair of spacer rings is disposed in sliding relationship around the tubular body intermediate the annular expansion and the non-seating end of the closure member, the spacer rings being separated by a snap ring carried by the valve body. The rings and annular expansion cooperatively define an annular chamber around the closure member, and the rings prevent downhole pressure from being communicated past the rings.

A helical spring is disposed around the closure member within the chamber for biasing the closure member towards the annular seat. A first annular, unidirectional seal is disposed in sealing engagement between the annular expansion and the interior annular wall of the tubular valve body for permitting fluid to pass out of the annular chamber but not into it. A second annular, undirectional seal is disposed around the closure member adjacent its non-seating end for permitting fluid to pass out of the chamber but not into the chamber.

An opening is provided in the closure member between the annular expansion and the seating end through which fluid may pass to the interior of the closure member when the valve is open. Means is also provided for selectively opening the seating end of the closure member in response to excessive downhole pressure to vent the downhole pressure past the valve.

In preferred embodiments, the means for selectively opening the seating end of the closure member is a spear assembly axially movably mounted in the closure member for movement between an open position and a closed position. In especially preferred embodiments, the spear is comprised of an upright spear mounted on a flat plate which has deformable depending legs which fit within the open seating end of the closure member. The spear assembly can be removed from the closure member by pulling upwardly on the spear with conventional wireline tools, thereby inwardly deforming the depending legs, and resulting in removal of the spear from the closure member. Similarly, the spear assembly can be reinserted in the closure member by deforming the depending legs inwardly until they are once again within the closure member.

In especially preferred embodiments, the unidirectional seal around the annular expansion of the closure member is held stationary by a pair of snap rings carried by the valve body. The annular expansion is thereby protected when the valve is in its open position because the annular expansion is contained within the annular chamber when the valve is open. This prevents exposure of annular expansion to the turbulent and abrasive flow of the drilling mud, thereby protecting the structural integrity of the closure member and preventing erosion of the surface of the annular expansion.

DETAILED DESCRIPTION OF THE PREFERRED EMBODIMENTS

Figure 1:
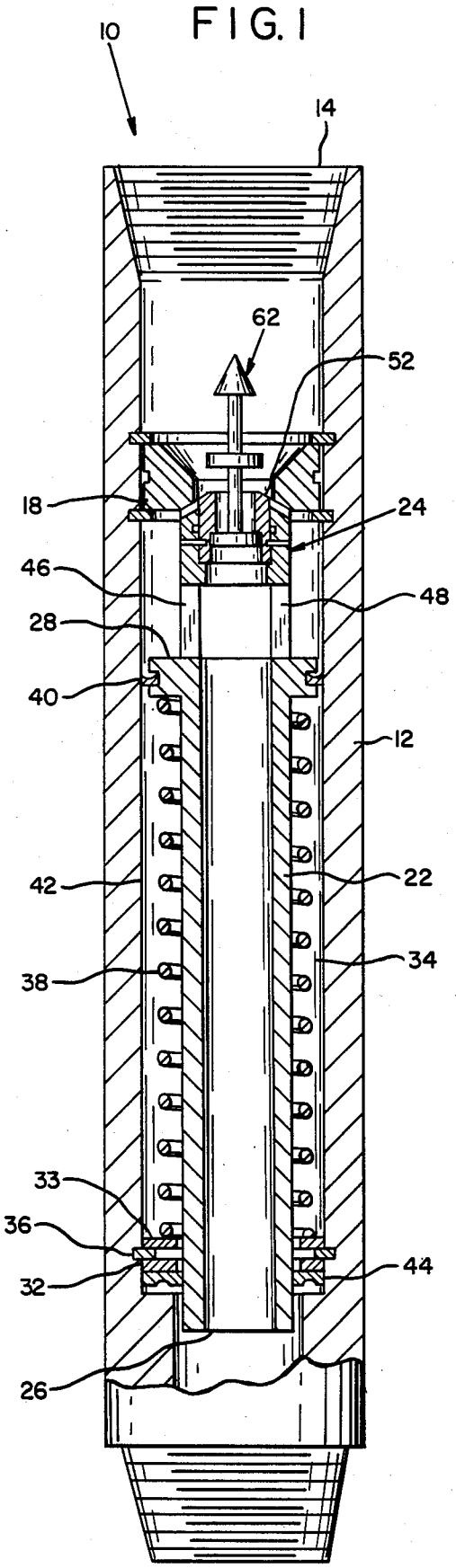
FIG. 1 is a side elevational view of the valve partially in cross section, the closure member being shown in the closed position with the spear assembly in an open position for venting downhole pressure past the valve.

In the first embodiment of the tool shown in FIGS. 1–4, a mud saver valve 10 is shown for preventing drilling mud from escaping from a kelly (not shown) when a drill string (not shown) is broken below the kelly. Valve 10 comprises a tubular valve body 12 having a first end 14 provided with internal threads for attaching first end 14 in fluid communicating relationship with the kelly. Body 12 is also provided with second end 16, which is externally threaded to provide a means for attaching body 12 to the internally threaded drill string.

An annular seat 18 is fixed in the interior of body 12 adjacent its first end 14, a downhole face 20 of annular seat 18 being beveled to form an annular, inclined surface.

A tubular closure member is slidingly disposed within body 12, closure member 22 being provided with a selectively closed seating end 24 for seating in valve closing engagement with annular seat 18. Closure member 22 is also provided with an open end 26 which establishes fluid communicating relationship between the interior of closure member 22 and the drill string. An annular flange 28 is disposed around closure member 22 adjacent seating end 24.

A face 30 of closure member 22 which seats against annular seat 18 is beveled to form an annular inclined surface, the beveled face 20 of annular seat 18 and beveled face 30 of closure member 22 cooperatively forming an annular inclined surface along which closure member 22 and annular seat 18 meet. In preferred embodiments, face 30 is comprised of tungsten carbide to provide an especially wear resistant surface which will withstand the wear of repeated opening and closing of the valve, as well as the erosive influence of the turbulent flow of the drilling mud past end 24.

A pair of spacer rings 32, 33 is disposed in sliding relationship around closure member 22 intermediate annular flange 28 and non-seating open end 26 of closure member 22. Spacer rings 32, 33 and annular flange 28 cooperatively define an annular chamber 34 around closure member 22, spacer rings 32, 33 being designed to prevent downhole pressure from being communicated past spacer rings 32, 33 and into chamber 34. A snap ring 36 is inserted into an indentation in the interior wall 42 of body 12 so that snap ring 36 is carried by body 12, thereby preventing longitudinal displacement of spacer ring 32 towards annular flange 28. A helical spring 38 is disposed around closure member 22 within chamber 34 for biasing closure member 22 towards annular seat 18 to maintain valve 10 in a normally closed position, spring 38 also exerting tension against spacer ring 33 to hold it against snap ring 36.

A first, annular unidirectional seal 40 is disposed in substantially sealing engagement between annular flange 28 and the interior annular wall 42 of body 12 for permitting fluid to pass out of chamber 34 but not into chamber 34. Seal 40 is mounted within an annular indentation in flange 28, and is carried by flange 28 in the first embodiment of the invention shown in FIGS. 1–4.

A second annular, unidirectional seal is disposed adjacent non-seating open end 26 of closure member 22 and in substantially sealing engagement between the exterior of closure member 22 and the interior annular wall 42 of body 12 for permitting fluid to pass out of chamber 34 but not into chamber 34, second seal 44 being adjacent spacer ring 32 but outside chamber 34.

Figure 2:
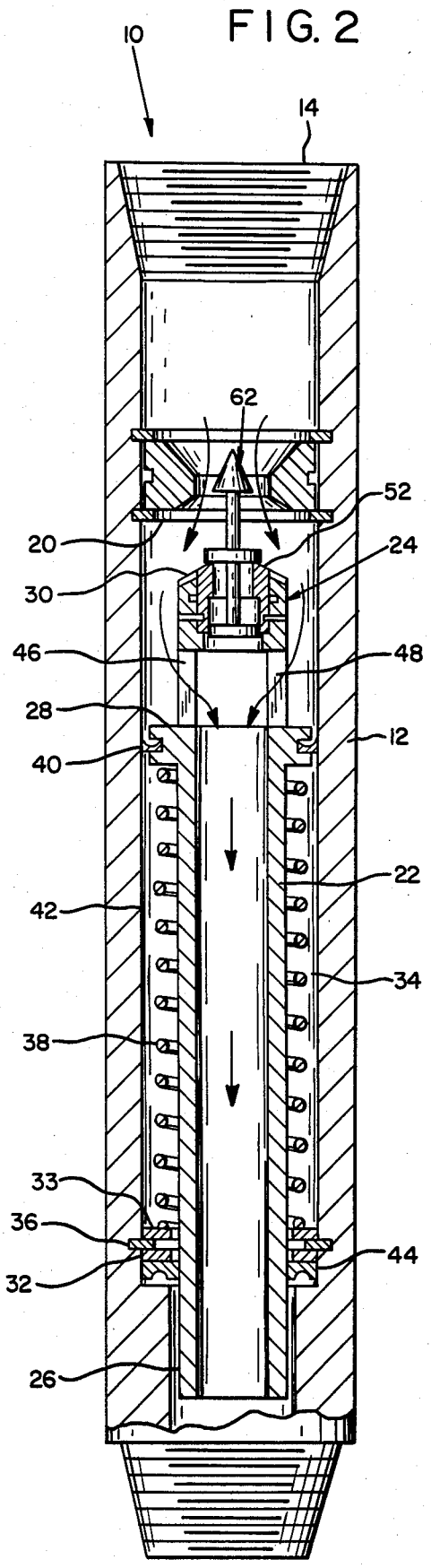
FIG. 2 is a view similar to FIG. 1 wherein the closure member is in an open position for permitting drilling mud to be introduced into the drill string, the spear assembly being closed.
Figure 3:
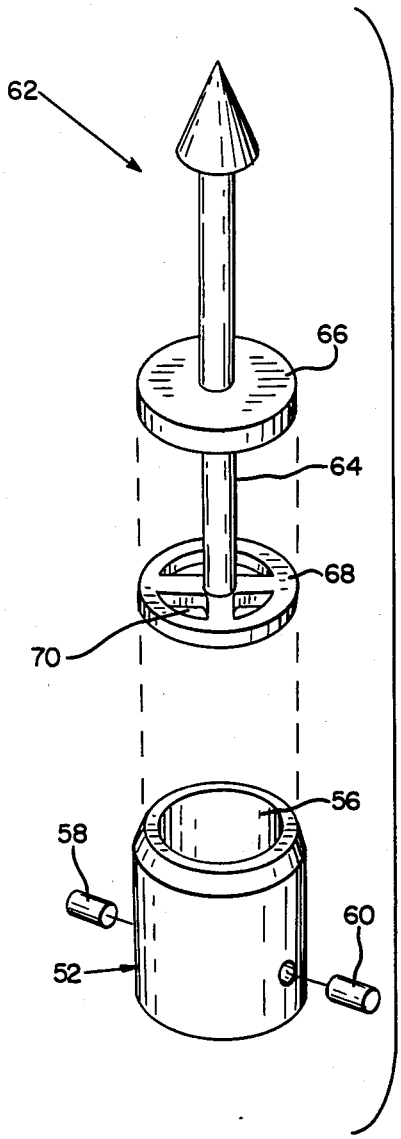
FIG. 3 is an enlarged, exploded view of the spear assembly and the sleeve in which it fits, the shear pins which retain the sleeve within the closure member also being shown.

A pair of opposing openings 46, 48 are provided in closure member 22 between annular flange 28 and seating end 24 through which fluid such as drilling mud may pass to the interior 50 of closure member 22 when valve 10 is in the open position shown in FIG. 2. The arrows in FIG. 2 indicate the flow path of drill mud.

Figure 4:
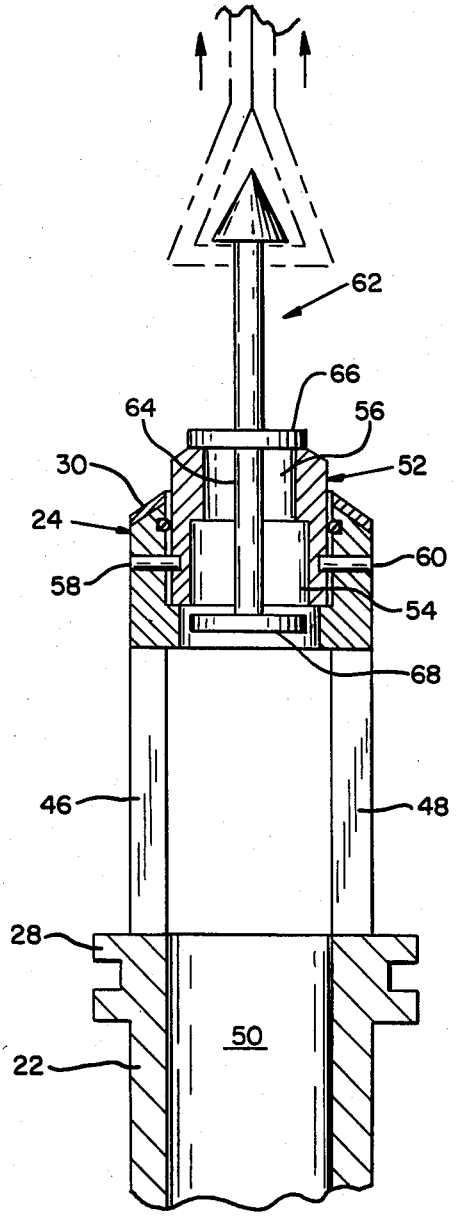
FIG. 4 is an enlarged fragmentary cross-sectional view of the closure member, the spear assembly being shown in its selectively closed position, the attachment of a wireline tool to the spear assembly being shown in phantom.

A tubular sleeve 52 (best shown in FIGS. 3 and 4) is mounted within seating end 24 of closure member 22, sleeve 52 being provided with a first open end 54 in fluid communicating relationship with the interior of closure member 22 and a second open end 56 in fluid communicating relationship with the exterior of closure member 22 through seating end 24. The inner diameter of sleeve 52 adjacent its first end 54 is greater than the inner diameter of sleeve 52 adjacent its second end 56. In the preferred embodiment shown in FIGS. 1-4, there are only two inner diameters in sleeve 52, a first inner diameter adjacent end 54, and a second, smaller inner diameter adjacent end 56. Sleeve 52 is retained in closure member 22 by means of shear pins 58, 60 as shown in FIG. 4.

A spear assembly 62 (shown in isolation in FIG. 3) is axially movably mounted within sleeve 52 for movement between a first position (shown in FIGS. 2 and 4) wherein said spear assembly 62 sealingly engages sleeve 52 to selectively close seating end 54 and a second position (shown in FIG. 1) wherein seating end 24 is open. Spear assembly 62 comprises a central shaft 64 surrounded by a first annular stop 66 and a second annular stop 68, said stops 66, 68 being in spaced, substantially parallel relationship to one another. First stop 66 has a diameter at least as great as the inner diameter of sleeve 52 adjacent its second end 56, first stop 66 seating against second end 56 of sleeve 52 when spear assembly 62 is in its first, closed position as shown in FIG. 2. The diameter of second stop 68 is greater than the inner diameter of sleeve 52 adjacent its second end 56, but the diameter of second stop 68 is less than the inner diameter of sleeve 52 adjacent its first end 54. This relationship retains spear assembly 62 in sleeve 52 when spear assembly 62 is in its second, open position shown in FIG. 1. Second stop 68 is provided with openings 70 (FIG. 3) through which downhole fluid pressure is communicated to first stop 66.

In operation, internally threaded end 14 of body 12 is attached to an externally threaded portion of the kelly, and externally threaded second end 16 of body 12 is threaded into an internally threaded end of a drill string. As drilling mud is pumped through the kelly into valve 10, the hydraulic force of the drilling mud above body 12 increases. Spacer rings 32, 33 and snap ring 36 cooperatively prevent downhole pressure from being exerted against any portions of closure member 22 except for an area equivalent to the outside diameter of open end 26 of closure member 22. The uphole pressure, however, can act against an area substantially equal to the outside diameter of annular flange 28. This means that uphole pressure acts against a greater surface area than downhole pressure, and since force is a function of hydraulic pressure multiplied times area, the effective uphole force acting to open valve 10 is magnified relative to the downhole force, resulting in an easier opening of the valve and more reliable maintaining of the valve in the open position. The pressure of the drilling mud in the vicinity of the tool is usually approximately 2500 psi, which results in the valve opening quickly and staying solidly open until drilling is stopped. Since opening of the valve relies on hydraulic force instead of the flow of the velocity of the drilling mud, the valve will not oscillate in response to variations in flow from duplex or triplex pumps. This represents a significant advance over the art represented by patents such as Hilliard and Parker et al which open in response to the flow of mud. Absence of oscillations in response to variations in flow gives a longer life to the tool since the sealing surfaces of the tool are not being worn away by constant oscillation.

The hydraulic force moves closure member 22 from the position shown in FIG. 1 against the bias of spring 38 to the position shown in FIG. 2. Drilling mud is then able to flow in the direction of the arrows in FIG. 2 through annular seat 18, past face 30 and into openings 46, 48 of closure member 22, thence to the interior 50 of closure member and out of open end 26 on its way to the drill string. When the drill string has been driven into below the surface, introduction of drilling mud is terminated, and the absence of uphole hydraulic force permits closure member to smoothly, quickly and firmly move with the bias of spring 38 back into the sealing position shown in FIG. 1. The uphole static hydraulic pressure is insufficient to open closure member 22 against the bias of spring 38, and the seal is maintained. It should also be noted that the beveled faces 20, 30 seal along an inclined plane, thereby providing a much better seal than those prior art devices employing a flat, annular seat and flat upper face on the closure member.

Pressure below valve 10 is communicated above the valve through spear assembly 62, which allows the driller to read a blowout through the drill pipe, eliminates the possibility of trapped pressure, and allow the driller to reverse circulate. When downhole pressure is encountered, it is communicated through openings 70 and a second stop 68 to first stop 66, thereby moving spear assembly 62 from the closed position shown in FIGS. 2 and 4 to the open position shown in FIG. 1. Downhole pressure is then vented through openings 70.

Spear assembly 62 is provided with a spearhead so that conventional wireline tools can be inserted into the valve and attached to the spearhead. An upward force exerted on the wireline tool (shown in FIG. 4) can then break shear pins 58, 60 so that sleeve 52 is removed from closure member 22. The shearing operation is only required on those occasions when it is necessary to run wireline tools past closure member 22, and valve 10 can be made operational again by reinserting shear pins 58, 60.

Figure 5:
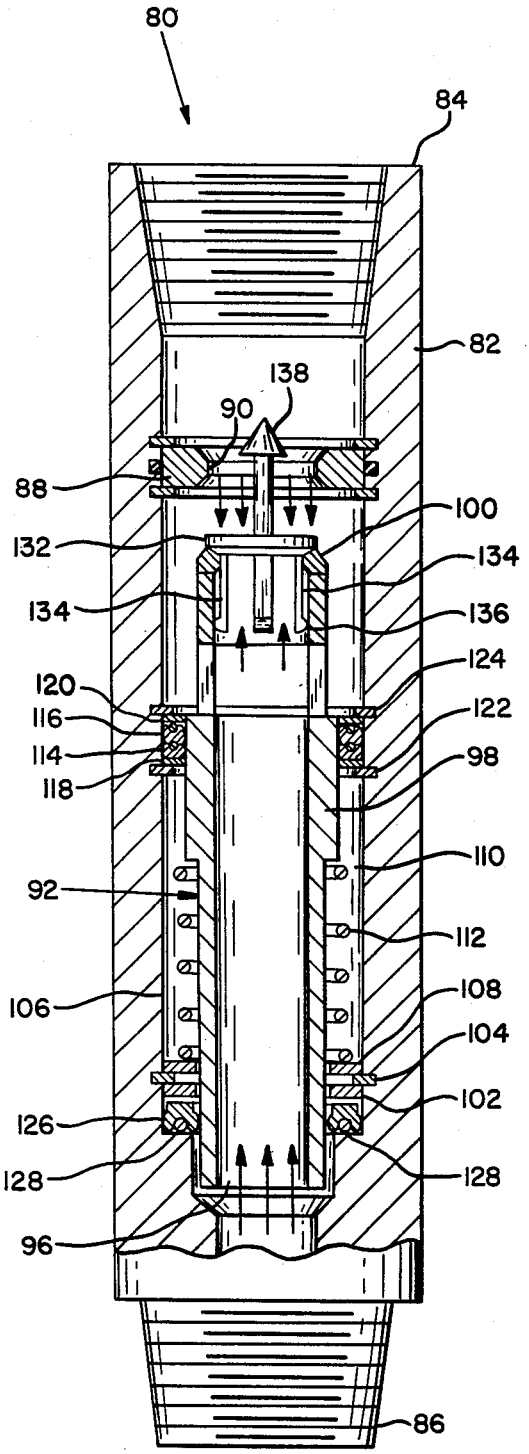
FIG. 5 is a side elevational view of a second embodiment of the invention, parts of the tool being shown in cross section for clarity, the valve being shown in an open condition and the spear assembly being shown in a closed conditions.
Figure 6:
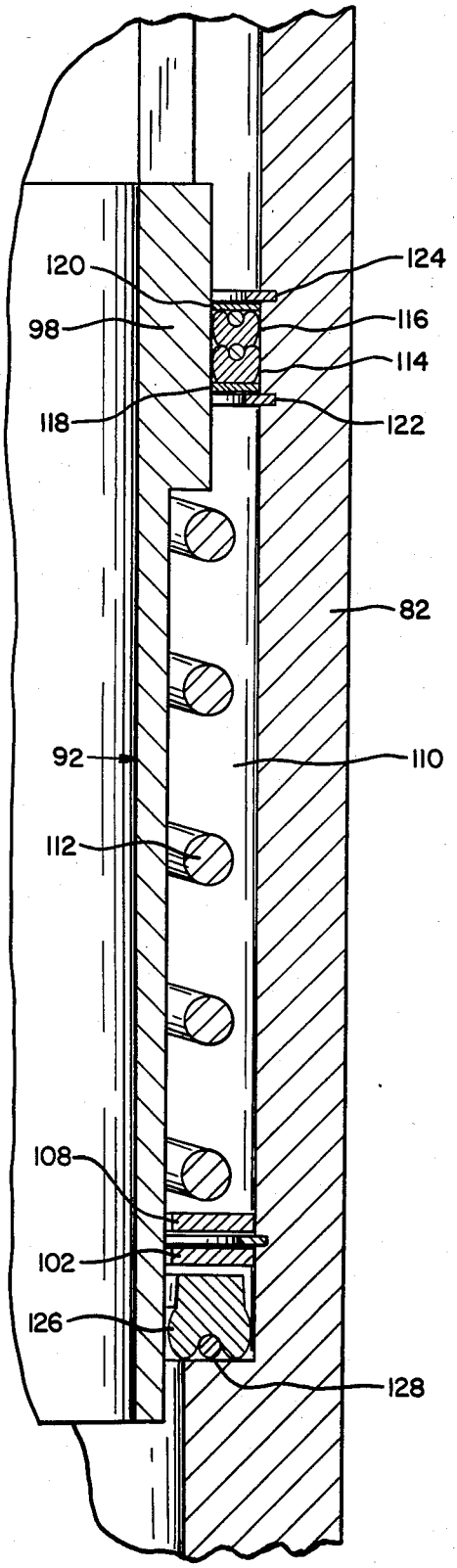
FIG. 6 is an enlarged, fragmentary view of the annular chamber between the seals in FIG. 5.
Figure 7:
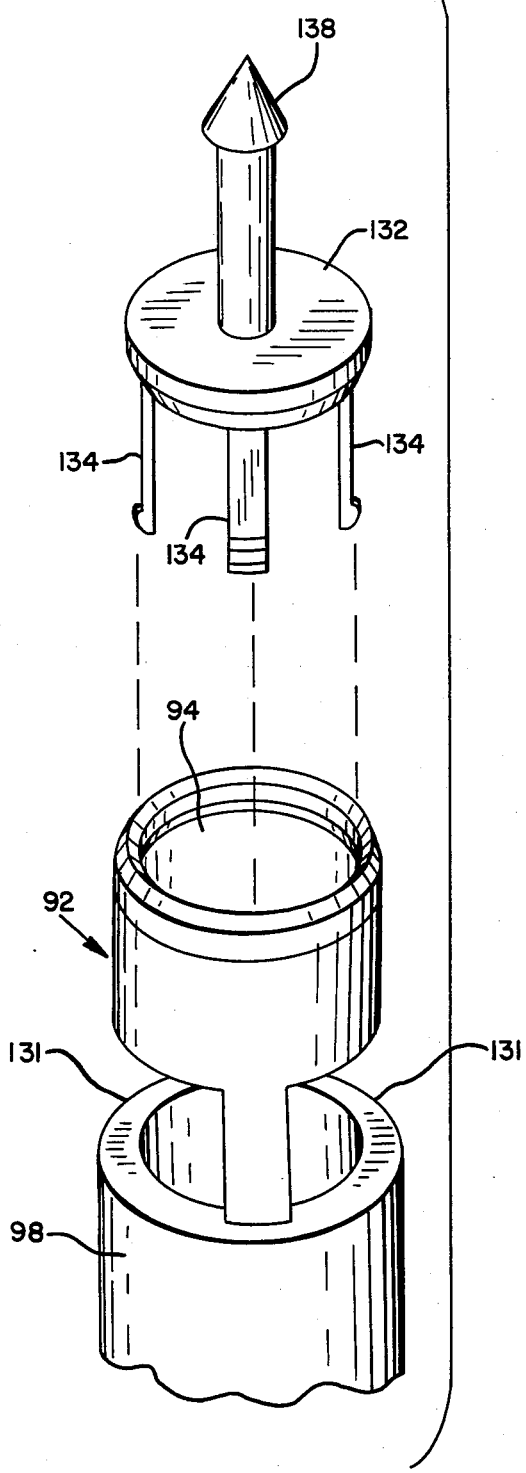
FIG. 7 is a perspective view of the seating end of the closure member showing the spear assembly removed from the closure member.
Figure 8:
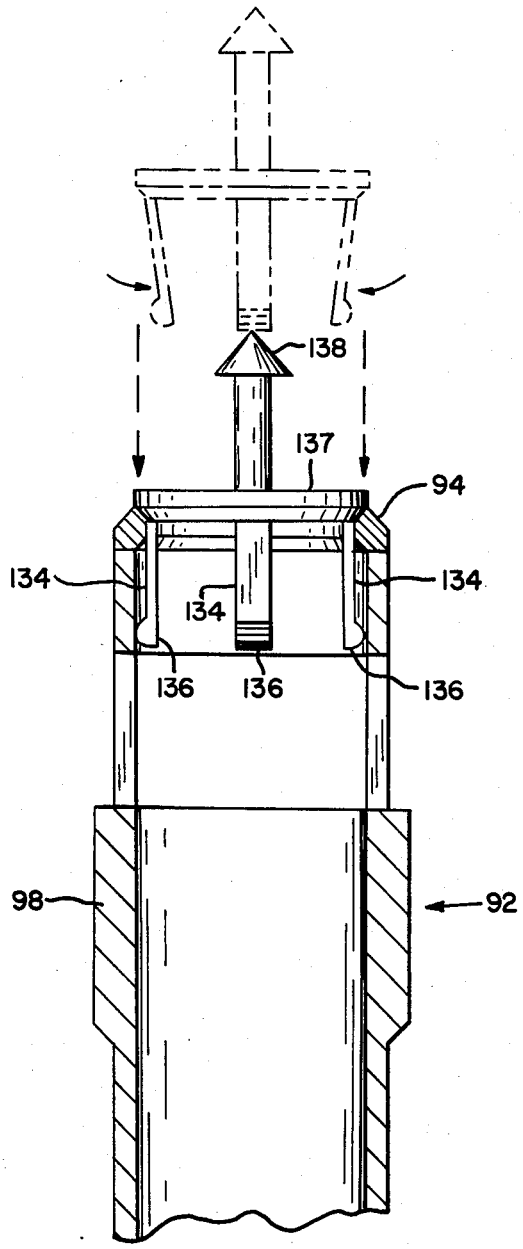
FIG. 8 is a cross sectional view of the closure member shown in FIG. 7, the spear assembly in its removed condition being shown in phantom.

In a second embodiment of the invention shown in FIGS. 5–8, several additional problems with prior art tools have been overcome. A mud saver valve 80 is shown in FIG. 5 for preventing drilling mud from escaping from a kelly when a drill string is broken below the kelly. Valve 80 comprises a tubular valve body 82 having a first open end 84 which is internally threaded for connection to a kelly, and a second open end 86 which is externally threaded for connection in fluid communicating relationship with a drillstring.

An annular seat 88 is fixed in the interior of valve 80 adjacent first end 84, a downhole face 90 of seat 88 being beveled to form an annular, inclined surface.

A tubular closure member 92 is disposed within valve body 82, and is provided with a selectively closed seating end 94 for seating in valve closing engagement with annular seat 90. Closure member 92 is also provided with an open end 96 in fluid communicating relationship with the drill string, and an annular expansion 98 around closure member 92 adjacent seating end 94. An annular uphole face 100 of closure member 92 is beveled to form an annular inclined surface, the beveled face 90 of seat 88 and beveled face 100 of closure member 92 cooperatively forming an inclined surface along which closure member 92 and seat 88 meet, thereby forming a more positive seal when the valve is in a closed position. Face 100 of closure member 92 is, in preferred embodiments, comprised of tungsten carbide to provide a longer wearing surface.

A first spacer ring 102 is disposed in sliding engagement around closure member 92 adjacent its non-seating open end 96, and an annular retainer 104 fits into an indentation in the interior wall 106 of body 82. A second spacer ring 108 is disposed in sliding engagement around closure member 92 on the opposite side of retainer 104 from first spacer ring 102. Spacer rings 102, 108 and annular expansion 98 cooperatively define an annular chamber 110 around closure member 92. The purpose of first and second spacer rings 102, 108 is, as in the first embodiment, to prevent downhole pressure from being communicated past them.

A helical spring 112 is disposed around closure member 92 within chamber 110 for biasing closure member 92 towards annular seat 88 to maintain valve 80 in a normally closed position. Spring 112 rests, in the preferred embodiment shown in FIGS. 5–8, on second spacer ring 108.

A pair of annular, unidirectional seals 114, 116, are disposed in substantially sealing engagement between annular expansion 98 and interior annular wall 106 of body 82 for permitting fluid to pass out of chamber 110 but not into chamber 110. Unidirectional seals 114, 116 are disposed between a pair of rings 118, 120, one ring on either side of seals 114, 116. Rings 118, 120 are maintained in a stationery position by a pair of retainer rings 122, 124 mounted in indentations in interior wall 104. Annular expansion 98 extends a sufficient longitudinal distance along closure member 92 to maintain seals 114, 116 in substantially sealing relationship with annular expansion 98. In other words, annular expansion 98 is in contact with seals 114, 116 along the full range of compression of closure member 92 against the bias of spring 112.

A downhole, annular unidirectional seal 126 is disposed adjacent open end 96 of closure member 92 and in substantially sealing engagement between the exterior of closure member 92 and the interior of annular wall 106 for permitting fluid to pass out of chamber 110 but not into chamber 110. Downhole seal 126 is adjacent first ring 102 and outside chamber 110, the inner diameter of valve body 82 being reduced between downhole seal 26 and second end 86 of body 82 to provide a shoulder 128 on which downhole seal 126 rests.

A pair of opposing openings 129, 131 are located in closure member 92 between annular expansion 98 and seating end 94 to provide orifices through which fluid, such as drilling mud, may pass to the interior of closure member 92 when valve 80 is open.

A circular plate 132 is provided and has four identical, depending, deformable legs 134 adapted for insertion into seating end 94 of closure member 92. The deformable legs are made of a malleable yet resilient material such as steel or aluminum, and legs 134 are provided with enlarged heads 136 for retaining plate 132 in axially sliding relationship with respect to closure member 92. Plate 132 is movable between a first position, shown in FIGS. 5 and 8, wherein plate 132 substantially sealingly closes seating end 94 of closure member 92 and a second position (not shown in the drawings) wherein seating end 94 is open as a result of the axial movement of plate 132 upwardly and away from seating end 94 in response to downhole pressure. An upwardly extending spear 138 is mounted fixedly on plate 132 and points toward first end 84 of valve body 82.

In operation, valve 80 functions in a similar fashion to the first embodiment described above. The primary differences in operation, however, are that annular expansion 98 moves against stationary seals 114, 116, as opposed to the first embodiment wherein the annular expansion carried the seals. The advantage of providing stationary seals and a movable annular expansion is that when closure member 92 opens against the bias of the spring (as shown in FIG. 5) annular expansion 98 moves into chamber 110, and is thereby protected from the turbulent, abrasive flow of the drilling mud. This is an advantage since the turbulent, abrasive flow of the drilling mud would otherwise wear away the sealing surface on annular expansion 98. Retooling and repair of the sealing surfaces is usually one of the most expensive and time consuming problems with prior art valves. Accordingly, making the seals stationary against a movable annular expansion is a remarkable advance in and of itself.

The spear and plate with deformable legs also differ from the spear assembly 62 in the first embodiment. The plate with deformable legs makes it possible to eliminate sleeve 52 and shear pins 58, 60 because plate 132 can be attached directly to closure member 92 by inwardly deforming legs 134 to fit them inside seating end 94 of closure member 92. Enlarged heads 136 then retain plate 132 in axially movable relationship within closure member 92 and seating end 94 is provided with a reduced diameter portion that retains heads 136 within closure member 92. Enlarged heads 136 also hold legs 134 in a substantially vertical position, which allows them to slide freely in and out of the reduced diameter portion of seating end 94. When it becomes necessary to remove plate 132, wireline tools grasp spear 138, and an upward pull of sufficient force inwardly deforms legs 134 to permit plate 132 and its associated parts to be removed from closure member 92. Reinsertion of plate 132 into closure member 92 is easily accomplished by inwardly deforming legs 134 until enlarged heads 136 fit into seating end 194.

I claim:

1. A mud saver valve for preventing drilling mud from escaping from a kelly when a drill string is broken below the kelly, said valve comprising:

a tubular valve body having first and second ends, said first end being provided with means for attachment in fluid communicating relationship with the kelly, said second end being provided with means for attachment to said drill string;

an annular seat fixed in the interior of said valve body adjacent its first end;

a tubular closure member within said valve body, said closure member being provided with a selectively closed seating end for seating in valve closing engagement with said annular seat, an open non-seating end in fluid communicating relationship with said drill string, and an annular expansion in the outer diameter of said closure member adjacent said seating end;

a top and bottom spacer ring disposed in sliding relationship around said tubular closure member intermediate said annular expansion and said non-seating end of said closure member, said spacer ring and annular expansion cooperatively defining an annular chamber around said closure member;

a helical spring disposed around said closure member within said chamber for biasing said closure member towards said annular seat;

an annular retainer between said top and bottom rings, said retainer being carried by said valve body for preventing longitudinal displacement of said bottom spacer ring towards said annular expansion and preventing downhole pressure from being communicated to said helical spring;

a first, annular, unidirectional seal disposed in substantially sealing engagement between said annular expansion and the interior annular wall of said tubular valve body for permitting fluid to pass out of said chamber but not into said chamber, said first unidirectional seal being maintained in a stationary position relative to said closure member by means embedded in said valve body, and said annular expansion of said closure member extending a sufficient length of said closure member to maintain said first unidirectional seal and said annular expansion in substantially sealing relationship as said closure member moves between a seating position and a non-seating position with said annular seat;

a second, annular, unidirectional seal disposed around said closure member adjacent said non-seating end of said closure member between said bottom spacer ring and said non-seating end of said closure member and in substantially sealing engagement between the exterior of said closure member and the interior annular wall of said tubular valve body for permitting fluid to pass out of said chamber but not into said chamber, said second unidirectional seal being stationery relative to said closure member, said inner diameter of said valve body being reduced between said second unidirectional seal and said second end of said valve body thereby forming a reduced diameter portion, said reduced diameter portion providing a shoulder on which said second unidirectional seal rests, said second unidirectional seal being disposed around said closure member adjacent said bottom spacer ring but outside said chamber, said helical spring resting on said top spacer ring;

an opening in said closure member between said annular expansion and said seating end through which fluid may pass to the interior of said closure member when said valve opens, against the bias of said helical spring; and means for selectively opening said seating end of said closure member in response to downhole pressure to vent said downhole pressure past said valve, said means for selectively opening said sealing and comprising a substantially circular plate with an upwardly extending spear pointing in the direction of said first end of said valve body, said plate further having a plurality of depending, deformable legs for insertion into the seating end of said closure member, said deformable legs having enlarged ends for retaining said plate in axially sliding relationship with respect to said closure member, said plate being movable between a first position wherein said plate substantially sealingly closes said seating end of said closure member and a second position wherein said seating end is open, the area between said legs defining pressure release openings through which downhole pressure is vented to the surface, an annular face of said annular seat against which said closure member seats being beveled, and an annular face of said seating end of said closure member which seats against said annular seat being cooperatively beveled so that said faces seat along an annular inclined surface, and wherein the annular bottom edge of the circular plate is inclined inwardly and downwardly, and the annular surface of the closure member against which the annular bottom edge of the closure plate seats is correspondingly inclined to provide an inclined sealing surface along which the circular plate and closure member seal.

2. A mud saver valve for preventing drilling mud from escaping from a kelly when a drill string is broken below the kelly, said valve comprising:

a tubular valve body having first and second ends, said first end being provided with means for attachment in fluid communicating relationship with said kelly, said second end being provided with means for attachment to said drill string;

an annular seat fixed in the interior of said valve body adjacent its first end, a downhole face of said seat being beveled to form an annular, inclined surface;

a tubular closure member within said valve body, said closure member being provided with a selectively closed seating end for seating in valve closing engagement with said annular seat, an open end in fluid communicating relationship with said drill string, and an annular expansion around said closure member adjacent said seating end, and annular uphole face of said closure member which seats against said annular seat being beveled to form an annular inclined surface, the beveled faces of said seat and closure member cooperatively forming an inclined surface along which said closure member and seat meet, said face of said closure member being comprised of tungsten carbide;

a first ring disposed in sliding engagement around said closure member adjacent said non-seating end of said closure member, an annular retainer adjacent said first ring and embedded in said valve body, and a second ring disposed in sliding engagement around said closure member on the side of said retainer opposite said first ring, said rings and annular expansion cooperatively defining an annular chamber around said closure member, said first and second rings and embedded retainer preventing downhole pressure from being communicated past said rings and into said chamber;

a helical spring disposed around said closure member within said chamber for biasing said closure member towards said annular seat, said spring resting on said second ring;

a pair of annular, unidirectional seals disposed in substantially sealing engagement between said annular expansion and the interior annular wall of said tubular valve body for permitting fluid to pass out of said chamber but not into said chamber, said pair of unidirectional seals being disposed between a pair of rings, one ring on either side of said pair of seals, said pair of rings being maintained in a stationary position by a pair of retainer rings embedded in said valve body, said annular expansion of said closure member extending a sufficient longitudinal distance along said closure member to maintain said pair of unidirectional seals in substantially sealing relationship with said annular expansion, said pair of seals being stationary relative to said closure member;

a downhole, annular unidirectional seal disposed adjacent said open end of said closure member and in substantially sealing engagement between the exterior of said closure member and the interior annular wall of said valve body for permitting fluid to pass out of said chamber but not into said chamber, said downhole seal being adjacent said first ring and outside said chamber, the inner diameter of said valve body being reduced between said downhole seal and said second end of said valve body to provide an annular flat shoulder on which said downhole seal rests;

an opening in said closure member between said annular expansion and said seating end through which fluid may pass to the interior of said closure member when said valve is open; and a circular plate having a plurality of depending, deformable legs for insertion into the seating end of said closure member, said deformable legs having enlarged ends for retaining said plate in axially sliding relationship with respect to said closure member, said plate being movable between a first position wherein said plate substantially sealingly closes the seating end of said closure member and a second position wherein said seating end is open, and an upwardly extending spear mounted on said plate and pointing towards said first end of said valve body, the area between the legs defining pressure release openings through which pressure is vented to the surface, the annular bottom edge of the circular plate being inclined inwardly and downwardly, and the annular surface of the closure member against which the annular bottom edge of the closure plate seats is correspondingly inclined to provide an inclined seating surface along which the circular plate and closure member seal.

* * * * *